US010645484B2

(12) United States Patent
Kwolek et al.

(10) Patent No.: US 10,645,484 B2
(45) Date of Patent: May 5, 2020

(54) LOUDSPEAKER CABINETS, SYSTEMS, AND METHODS OF CONSTRUCTION

(71) Applicants: Tadeusz Kwolek, Beringen (CH); Robert Kwolek, Beringen (CH)

(72) Inventors: Tadeusz Kwolek, Beringen (CH); Robert Kwolek, Beringen (CH)

( * ) Notice: Subject to any disclaimer, the term of this patent is extended or adjusted under 35 U.S.C. 154(b) by 387 days.

(21) Appl. No.: 15/854,483

(22) Filed: Dec. 26, 2017

(65) Prior Publication Data

US 2018/0184197 A1 Jun. 28, 2018

Related U.S. Application Data

(60) Provisional application No. 62/438,885, filed on Dec. 23, 2016.

(51) Int. Cl.
*H04R 1/28* (2006.01)
*H04R 1/02* (2006.01)

(52) U.S. Cl.
CPC ..... *H04R 1/2819* (2013.01); *H04R 1/028* (2013.01); *H04R 1/2888* (2013.01); *H04R 1/2857* (2013.01); *H04R 2201/029* (2013.01)

(58) Field of Classification Search
CPC .. H04R 1/2807; H04R 1/2811; H04R 1/2888; H04R 2201/029; H04R 1/2815; H04R 1/2819; H04R 1/2826; H04R 1/2857; H04R 1/2896
See application file for complete search history.

(56) References Cited

U.S. PATENT DOCUMENTS

| | | | | |
|---|---|---|---|---|
| 2,121,008 A * | 6/1938 | Bilhuber | ..... | H04R 1/2811 381/392 |
| 3,275,100 A | 9/1966 | Dunning | | |
| 4,213,515 A | 7/1980 | Laupman | | |
| 4,440,260 A | 4/1984 | Jacobsen | | |
| 4,598,178 A | 7/1986 | Rollins | | |
| 4,624,337 A | 11/1986 | Shavers | | |
| 4,805,729 A * | 2/1989 | Wascom | ..... | H04R 1/26 181/144 |
| 5,115,884 A | 5/1992 | Falco | | |

(Continued)

FOREIGN PATENT DOCUMENTS

EP 1173040 A2 1/2002

*Primary Examiner* — Jeremy A Luks
(74) *Attorney, Agent, or Firm* — Roberts IP Law; John Roberts

(57) ABSTRACT

A loudspeaker cabinet comprised of interlocking panels which may be assembled using external compressive forces and internal tensile forces is described. The panels may include corresponding tongue and groove elements that aid in the interconnection of the panels, and which may be at least partially swaged together. Internal tension members, such as tension rods, may run the length of the cabinet, up and down, and front to back, to keep panels of the cabinet under constant tension. An example cabinet body having six sides that sits above an integrated foot or shelf is constructed out of three interlocking panels. The present system and method may be used to create an inherently rigid cabinet that minimizes the movability of its constituent parts to avoid parasitic vibrations that interfere with the original sound waves emanating from the membrane of the driver of the loudspeaker.

18 Claims, 11 Drawing Sheets

(56) References Cited

U.S. PATENT DOCUMENTS

| | | | | |
|---|---|---|---|---|
| 5,696,357 | A * | 12/1997 | Starobin | H04R 1/2819 181/156 |
| 5,996,728 | A | 12/1999 | Stark | |
| 6,130,951 | A * | 10/2000 | Nakamura | H04R 25/00 381/337 |
| 6,176,346 | B1 * | 1/2001 | Wiener | H04R 1/02 181/199 |
| 6,513,624 | B2 | 2/2003 | Coffin | |
| 6,588,544 | B2 * | 7/2003 | Fox | H04R 1/021 181/148 |
| 6,628,797 | B2 * | 9/2003 | Yamada | H04R 1/2888 181/153 |
| 8,837,768 | B2 * | 9/2014 | Subat | H04R 1/2803 381/389 |
| 9,131,301 | B2 * | 9/2015 | Tsai | H04R 1/02 |
| 9,154,865 | B2 * | 10/2015 | Zha | H04R 1/021 |
| 9,282,386 | B2 * | 3/2016 | Low | B23P 11/00 |
| 10,028,050 | B2 * | 7/2018 | Han | H04R 1/2834 |
| 10,499,129 | B2 * | 12/2019 | Borne | H04R 1/023 |
| 2002/0036113 | A1 * | 3/2002 | Chu | H04R 1/2888 181/199 |
| 2003/0213642 | A1 | 11/2003 | Powell | |
| 2007/0158134 | A1 * | 7/2007 | Fryette | H04R 1/02 181/199 |
| 2007/0165895 | A1 * | 7/2007 | Matsumura | H04R 1/2803 381/351 |
| 2011/0000740 | A1 | 1/2011 | Carter | |
| 2015/0156574 | A1 * | 6/2015 | Wilson | H04R 1/026 181/199 |

* cited by examiner

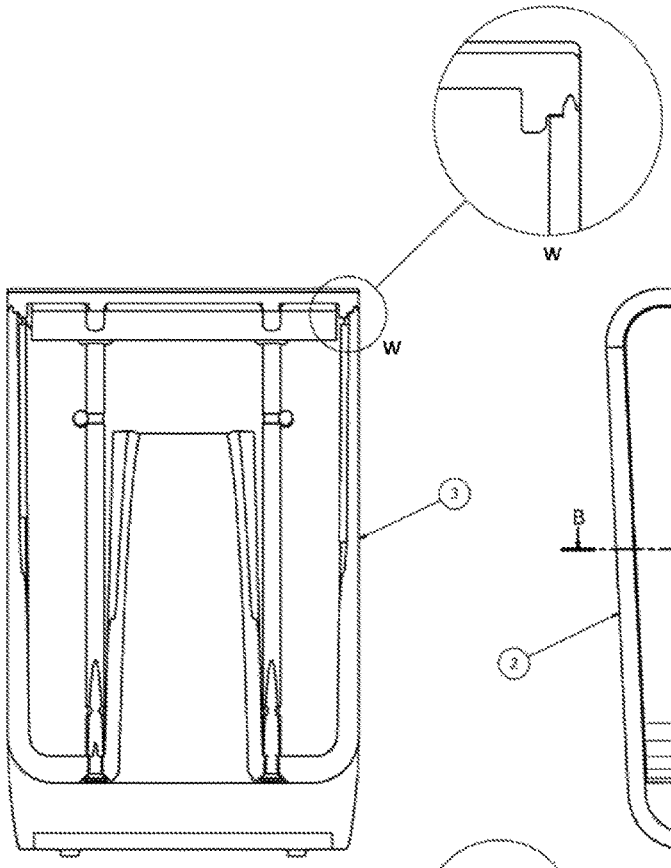
FIG. 5 A-A
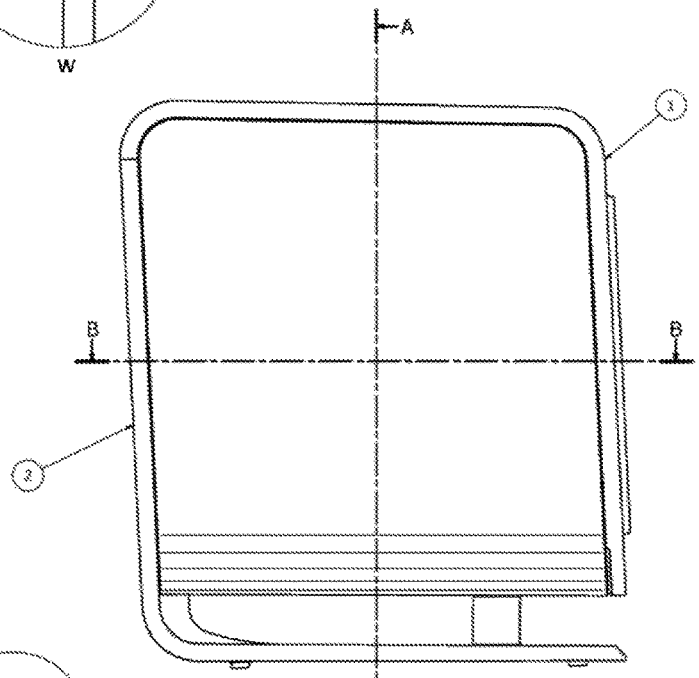
FIG. 5
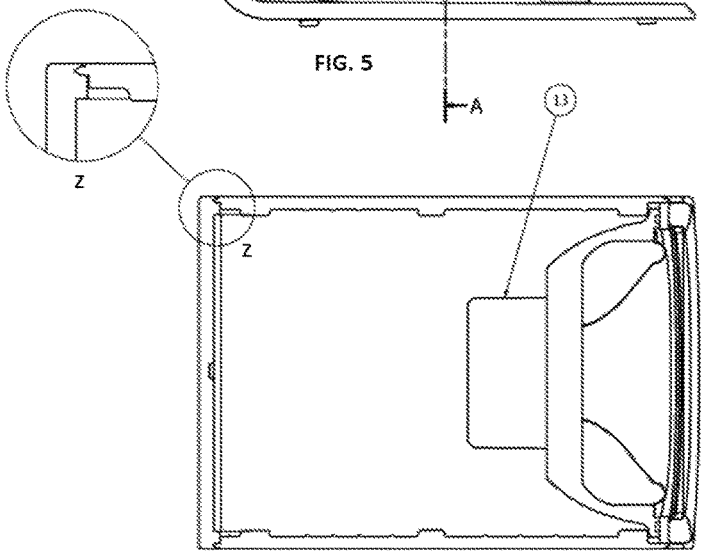
FIG. 5 B-B

LOUDSPEAKER CABINETS, SYSTEMS, AND METHODS OF CONSTRUCTION

CROSS-REFERENCE TO RELATED APPLICATIONS

The present application claims priority to, incorporates herein by reference, and is a non-provisional of, U.S. provisional patent application Ser. No. 62/438,885, which was filed on Dec. 23, 2016.

FEDERALLY SPONSORED RESEARCH OR DEVELOPMENT

None.

TECHNICAL FIELD

Embodiments of the invention relate to loudspeakers, and more particularly to cabinets for loudspeakers.

BACKGROUND

For a loudspeaker cabinet, it is desirable to reduce or eliminate unfavorable resonances which may impact negatively the sound emitted from the loudspeaker product. For example, U.S. Pat. Nos. 5,115,884, 4,624,337, 4,598,178, 4,213,515, 4,440,260, and 3,275,100, all of which are incorporated herein by reference, disclose various measures that have be taken to dampen vibrations caused by mounting panels of loudspeaker cabinets. Each of these prior systems has various design drawbacks as will be apparent to persons of skill in the art, with respect to complexity, cost, weight, robustness, and other factors. Accordingly, there is a need to provide an audio loudspeaker cabinet that ensures low unfavorable resonances, while overcoming various drawbacks of prior systems.

SUMMARY

Various aspects of the present invention elegantly overcome many of the drawbacks of prior systems and provide numerous additional improvements and benefits as will be apparent to persons of skill in the art. The present system and method may be used to create an inherently rigid cabinet that minimizes the movability of its constituent parts to avoid parasitic vibrations that interfere with the original sound waves emanating from the membrane of the driver of the loudspeaker. For example, provided in various example embodiments is an enclosed loudspeaker cabinet having at least a front side, back side, left side, right side, top side, and bottom side, formed from a plurality of panels joined together at tongue-and-groove joints that are held in forcible engagement by at least one tension member within the loudspeaker cabinet attached with and extending between two or more of the plurality of panels.

By way of non-limiting example, provided in various example embodiments is an enclosed loudspeaker cabinet having at least a front side, back side, left side, right side, top side, and bottom side, formed from three panels, comprising: a first panel comprising a continuous outer edge having a first cross-section defining a convex shape; a second panel comprising a first surface defining a first concave groove having a second cross-section sized and shaped to correspond to the convex shape of the first cross-section of the continuous outer edge of the first panel, the first concave groove extending along a first path sized and shaped to correspond to at least a first portion of the continuous outer edge of the first panel; a third panel comprising a second surface defining a second concave groove having a third cross-section sized and shaped to correspond to the convex shape of the first cross-section of the continuous outer edge of the first panel, the second concave groove extending along a second path sized and shaped to correspond to at least a second portion of the continuous outer edge of the first panel; the second and third panels in forcible engagement with the first panel such that the continuous outer edge of the first panel is seal-ably adjoined into both the first concave groove of the second panel and the second concave groove of the third panel.

In various example embodiments the continuous outer edge of the first panel is at least partially swaged into both the first concave groove of the second panel and the second concave groove of the third panel. In various example embodiments the convex shape of the first cross-section of the continuous outer edge of the first panel comprises a V-shape. In various example embodiments the first, second, and third panels are cast aluminum, though any suitable materials may be used.

In various example embodiments the enclosed loudspeaker cabinet may further comprise at least first tension members and second tension members within the loudspeaker cabinet, wherein the first tension members extend from the second panel to the third panel, and the second tension members extend from the first panel to the second panel; the first tension members urging the second and third panels against the first panel; and the second tension members urging the first panel against the second panel. In various example embodiments the first tension members extend in a first longitudinal direction and the second tension members extend in a second longitudinal direction, and the first longitudinal direction is substantially perpendicular to the second longitudinal direction. In various example embodiments the first tension members comprise four tension members, and the second tension members comprise two tension members.

In various example embodiments the enclosed loudspeaker cabinet may further comprise a foot portion extending laterally under the bottom side, wherein the first panel is generally U-shaped in cross-section and the second and third panels are each generally L-shaped in cross-section, and the second and third panels are attached to the first panel so that a portion of the third panel extends laterally under the first panel, forming the foot portion. In various example embodiments the enclosed loudspeaker cabinet may further comprise a rigid spacer extending between the foot portion and the bottom side. In various example embodiments the enclosed loudspeaker cabinet may further comprise a speaker driver mounted in an opening in the second panel. In various example embodiments the speaker driver comprises a frame mounted adjacent the second panel that reinforces the second panel.

Also provided in various example embodiments is a method of assembling from three panels an enclosed loudspeaker cabinet having at least a front side, back side, left side, right side, top side, and bottom side, comprising the steps of: providing a first panel comprising a continuous outer edge having a first cross-section defining a convex shape; providing a second panel comprising a first surface defining a first concave groove having a second cross-section sized and shaped to correspond to the convex shape of the first cross-section of the continuous outer edge of the first panel, the first concave groove extending along a first path sized and shaped to correspond to at least a first portion of the continuous outer edge of the first panel; providing a third panel comprising a second surface defining a second concave groove having a third cross-section sized and shaped to correspond to the convex shape of the first cross-section of the continuous outer edge of the first panel, the second concave groove extending along a second path sized and shaped to correspond to at least a second portion of the continuous outer edge of the first panel; and assembling together the first, second, and third panels by forcing the continuous outer edge of the first panel into both the first concave groove of the second panel and the second concave groove of the third panel.

In various example embodiments the steps of forcing the continuous outer edge of the first panel into both the first concave groove of the second panel and the second concave groove of the third panel, further comprise the steps of: placing the loudspeaker cabinet into a pressing machine, such as a mechanical or hydraulic press, for instance, and causing the pressing machine to apply force to one or more of the first, second, and third panels to force the continuous outer edge of the first panel into both the first concave groove of the second panel and the second concave groove of the third panel. In various example embodiments the method may further comprise the steps of at least partially swaging the continuous outer edge of the first panel into both the first concave groove of the second panel and the second concave groove of the third panel.

In various example embodiments the method may further comprise the steps of urging the continuous outer edge of the first panel into both the first concave groove of the second panel and the second concave groove of the third panel by: providing at least first tension members and second tension members within the loudspeaker cabinet, wherein the first tension members extend from the second panel to the third panel, and the second tension members extend from the first panel to the second panel; applying tension to the first tension members and thereby urging the second and third panels against the first panel; and applying tension to the second tension members and thereby urging the first panel against the second panel.

In various example embodiments the first panel is generally U-shaped in cross-section and the second and third panels are each generally L-shaped in cross-section. In various example embodiments the method may further comprise the steps of assembling from the first, second, and third panels an enclosed loudspeaker cabinet having at least a front side, back side, left side, right side, top side, bottom side, and foot portion extending laterally under the bottom side, by attaching the second and third panels to the first panel so that a portion of the third panel extends laterally under the first panel.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

The accompanying figures, drawings, and photographs illustrate certain aspects of example embodiments of the invention, wherein:

FIG. 5 is a side elevation view of the cabinet shown in FIG. 1;

FIG. 5 A-A is a cross-sectional view of cabinet of FIG. 5 taken through line A-A, with an enlarged detail W showing example tongue and groove elements in an assembled position;

FIG. 5 B-B is a cross-sectional view of cabinet of FIG. 5 taken through line B-B, with an enlarged detail Z showing example tongue and groove elements in an assembled position;

DETAILED DESCRIPTION OF EXAMPLE EMBODIMENTS

Figure 1:
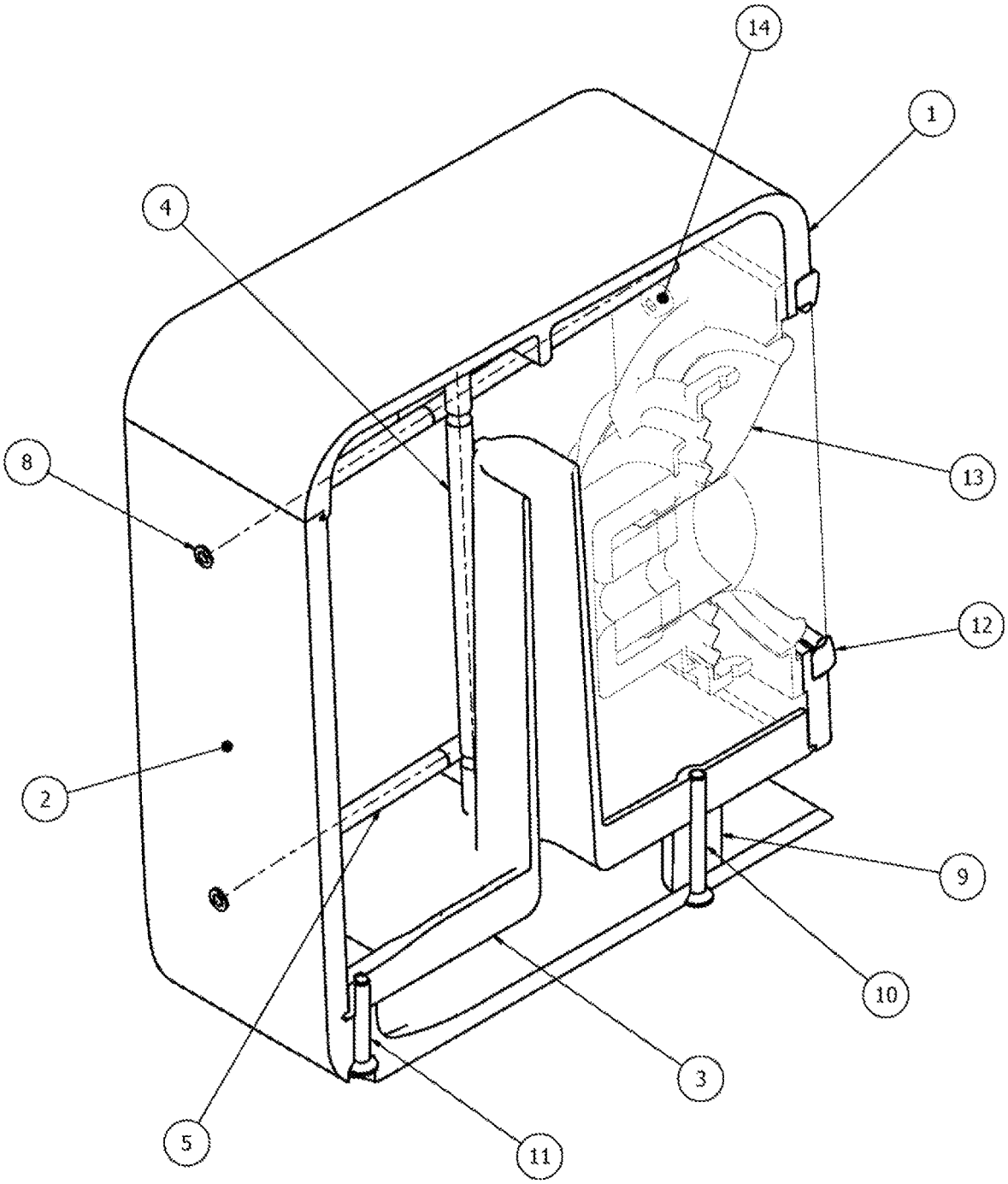
FIG. 1 is a perspective view of a cross-section of an example loudspeaker cabinet according to various example embodiments.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims. As used herein the terms "vertical" and "horizontal" are intended to mean either roughly vertical and roughly horizontal, respectively, or simply two arbitrary directions that are roughly perpendicular to each other (for instance, depending on the orientation and positioning of the speaker cabinet), as will be apparent to persons of skill in the art upon reviewing the present specification and figures.

Panels of loudspeaker cabinets are exposed to pulsating air pressure created by the movement of the loudspeaker driver's membrane. The amplitude of the vibration of the cabinet panels depends on the size and stiffness of the panels and the pressure of the air displaced by the driver's membrane.

A traditional method to reduce cabinet vibrations is the implementation of bracing inside the cabinet, and gluing or screwing the external panels to the braced construction. To effectively reduce vibrations, the number of braces typically must be substantial and the distance between them reduced to a minimum, to raise the vibrational frequency high enough to not be audible, and reduce distortions to levels not detectable in normal listening conditions.

Provided in various example embodiments is a speaker cabinet, system, and method, with alternative features, configurations, and aspects, one example of which is illustrated in the accompanying figures. In a first example aspect, instead of substantial bracing, which can occupy most of the cabinets' interior, tension may be applied to the cabinet panels with the use of tension rods, cables, or equivalent longitudinally-extending members 4, 5, capable of transmitting tension, and fastening members 7, 8, such as locking screws. The use of internal tension members 4, 5, can help reduce or eliminate the need for conventional bracing by applying tension forces to the cabinet panels. The result is that vibrations are substantially reduced, thinner-wall and lighter cabinet materials can be used, all whilst being a simpler and more efficient method of vibration control. This approach can be analogized to that of guitar strings tuned to a higher pitch. The stronger the tension, the higher the pitch, and lower the amplitude of the string. When the tensions applied to the panels are high enough, the vibrations of the cabinet can be reduced to levels below those detectable in normal listening situations. This approach also allows for much better utilization of the cabinet's internal volume, as the only internal components required are tension members, such as the rods and spacers shown in the example figures.

Figure 3:
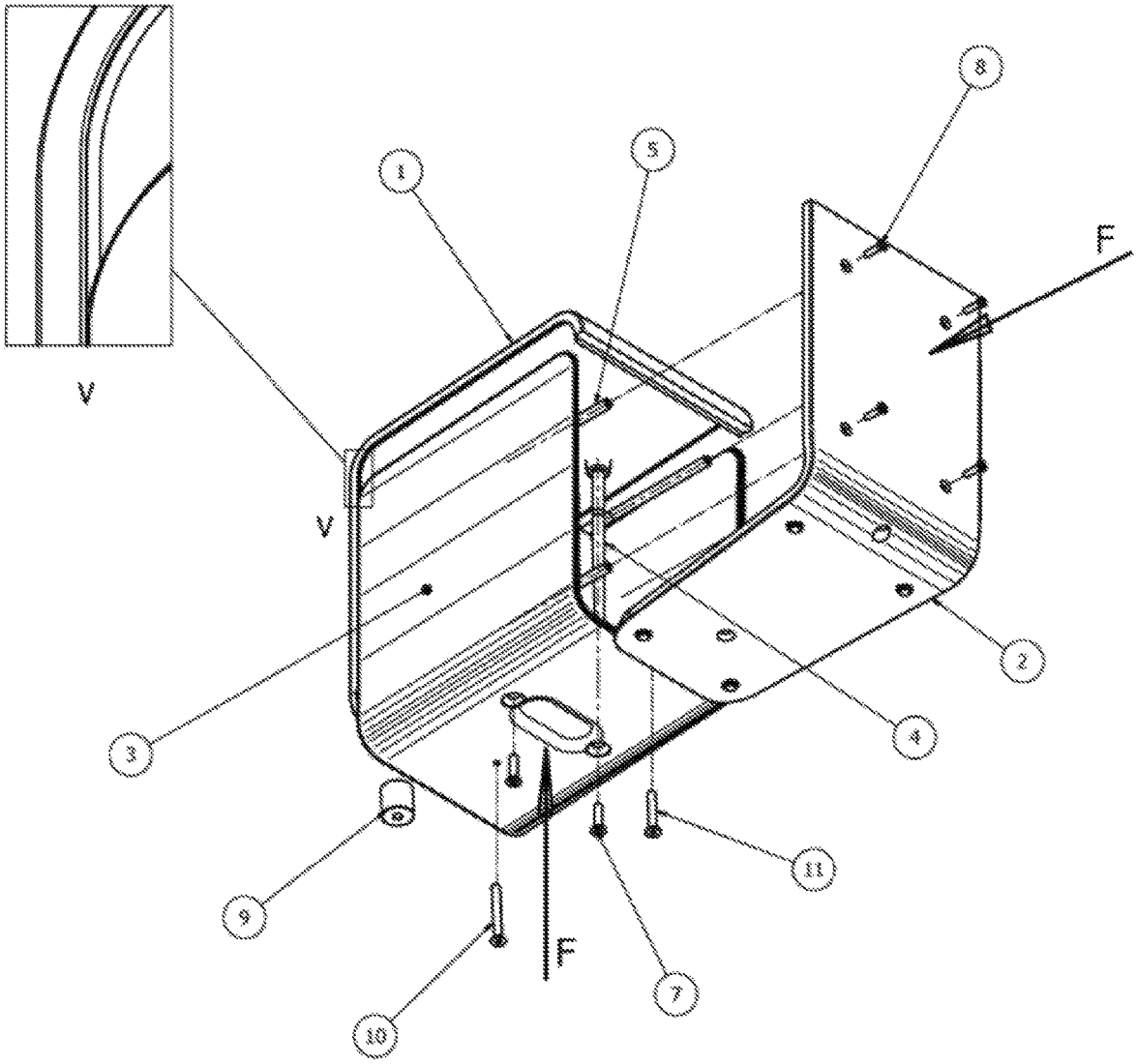
FIG. 3 is a partially-exploded back perspective view of the cabinet shown in FIG. 1, showing enlarged details of certain example tongue and groove elements.
Figure 4:
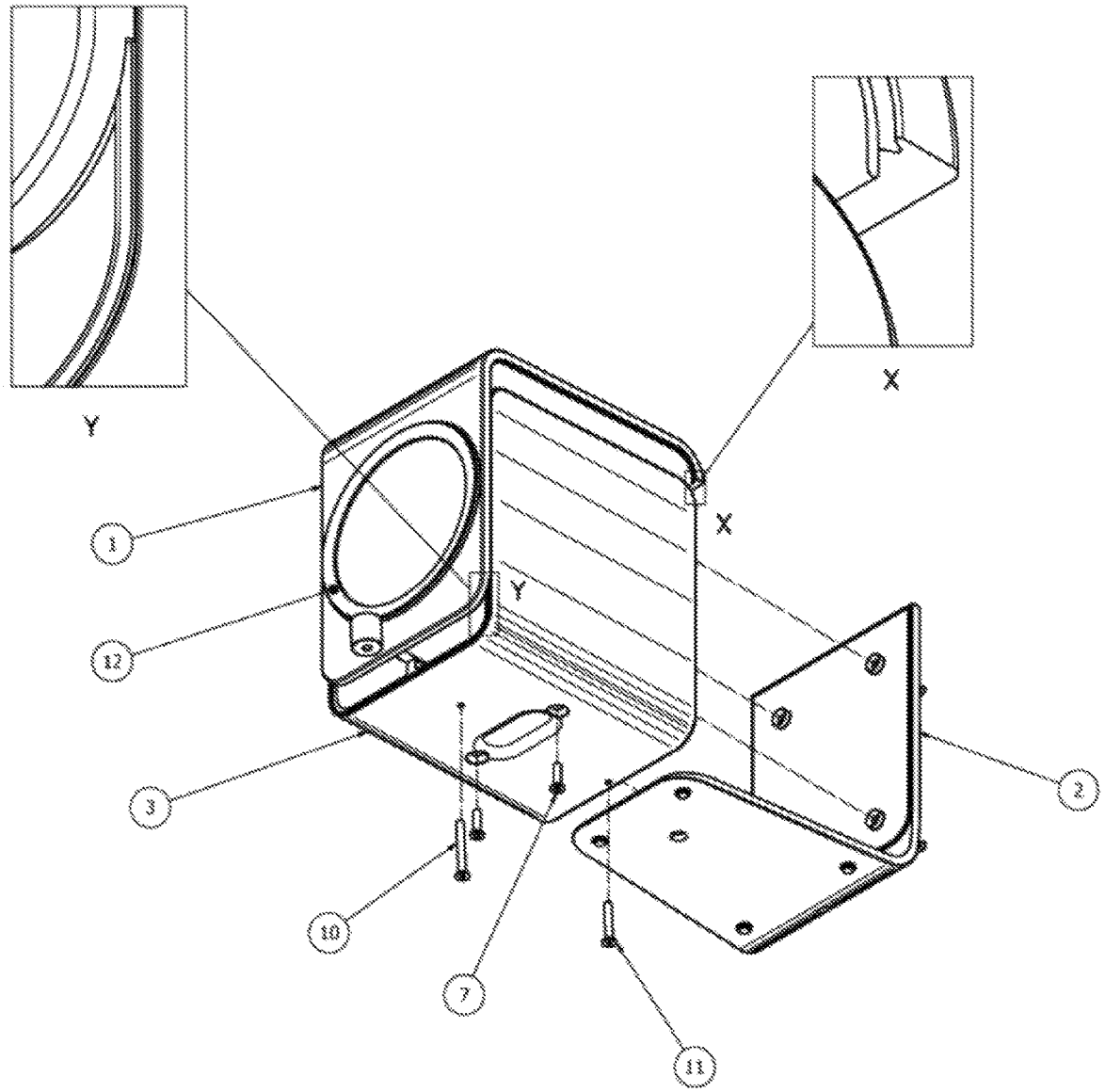
FIG. 4 is a partially-exploded front perspective view of the cabinet shown in FIG. 1, showing enlarged details X and Y of certain example tongue and groove elements, shown in a disassembled or partially disassembled positions.

In another example aspect, a speaker cabinet can be formed from panels that intersect at or near their respective edges with corresponding tongue-and-groove connections, as depicted in zoomed-in views V, W, X, Y, Z in FIGS. 3 through 5 B-B. For example, in certain example embodiments, a first panel 3 may comprise an edge having a convex or pointed cross-section, such as a V-shaped cross-section, that is sized and shaped to fit closely in a correspondingly-sized and shaped concave groove in a second panel 1, such as a groove having a V-shaped cross-section. The first and second panels 3, 1, may be forced and held together upon assembly such that the convex edge of the first panel 3 is held in compression against the correspondingly-shaped concave groove in the second panel 1. Additionally, in the example embodiment shown in the figures, a third panel 2 may likewise comprise a concave groove correspondingly-sized and shaped to receive the convex or pointed edge of first panel 3. The first, second, and third panels 3, 1, 2, may be forced and held together upon assembly such that the convex edge of the first panel 3 is held in compression against the correspondingly-shaped concave grooves in both the second and third panels 1, 2.

Another example aspect is providing a speaker cabinet having an outer body formed from three interconnecting, curved, one-piece panels. For example, such a three-piece speaker cabinet outer body may comprise a first one-piece panel 3 that is roughly U-shaped in cross-section and has an exterior surface that forms a first vertical side of the cabinet, a second vertical side of the cabinet opposite the first vertical side of the cabinet, and a first horizontal side of the cabinet, wherein the exterior surface comprises a continuous outer edge having a convex cross-section, such as a V-shaped cross-section, which runs uninterrupted along the entire outer edge of the first panel 3.

An additional example aspect is providing a speaker cabinet comprising a second one-piece panel 1 that is roughly L-shaped in cross-section and that has an exterior surface that forms at least a third vertical side of the cabinet and a second horizontal side of the cabinet, and has an interior surface opposite the exterior surface, with a groove formed near outer edges of the interior surface and that is sized and shaped to receive therein corresponding portions of the continuous outer edge of the first one-piece panel 3.

A further example aspect is providing a speaker cabinet comprising a third one-piece panel 2 that is roughly L-shaped in cross-section and has an exterior surface that forms at least a fourth vertical side of the cabinet and a horizontal shelf that extends at least partially under the first horizontal side of the cabinet. The third one-piece panel 2 may further comprise an interior surface opposite the exterior surface, with a groove formed therein that is located, sized, and shaped to receive therein corresponding portions of the continuous outer edge of the first one-piece panel 3.

FIG. 1 illustrates a perspective view of a cross-section of an example loudspeaker cabinet exhibiting non-limiting examples of certain designs, systems, and methods of construction. Provided in certain example embodiments is a cast aluminum roughly L-shaped front panel 1, which is also reinforced by "sandwiching" it between a loudspeaker driver 13 and a front metal grill ring 12. The grill 12 may comprise acoustically transparent mesh and serve as an external protection of the driver's 13 membrane. A roughly U-shaped cast aluminum side panel 3 may be forcefully assembled to the top of the front panel 1 in part by using vertical tension rods 4 that run top to bottom. As shown in FIGS. 3 and 4, a roughly L-shaped cast aluminum rear-and-foot panel 2 may be assembled to the sub-assembly of the front panel 1 and side panel 3 by horizontal tension rods 5 that run front to back. The foot or lower shelf portion of the rear panel 2 may be additionally connected with the lower portion of the side panel 3 by a foot support 9, which may be formed from a rigid material such as metal (for instance, aluminum, steel, etc.), and fastener 10 as well as rearward-located fasteners 11 (see FIG. 1). Various aspects of this construction help to prevent vibration of the cabinet from the reaction forces of the membrane. While any suitable materials may be used for any of the components of the speaker, such as metal, hard wood, or a rigid composite resin, for example, it has been found that cast materials, such as cast aluminum, can help mute the transmission of vibrational energy, withstand the forces from the tension rods, and are also readily manufactured into cabinet panels having V-shaped or other convexly-shaped edges and correspondingly-shaped and positioned concave grooves.

Figure 2B:
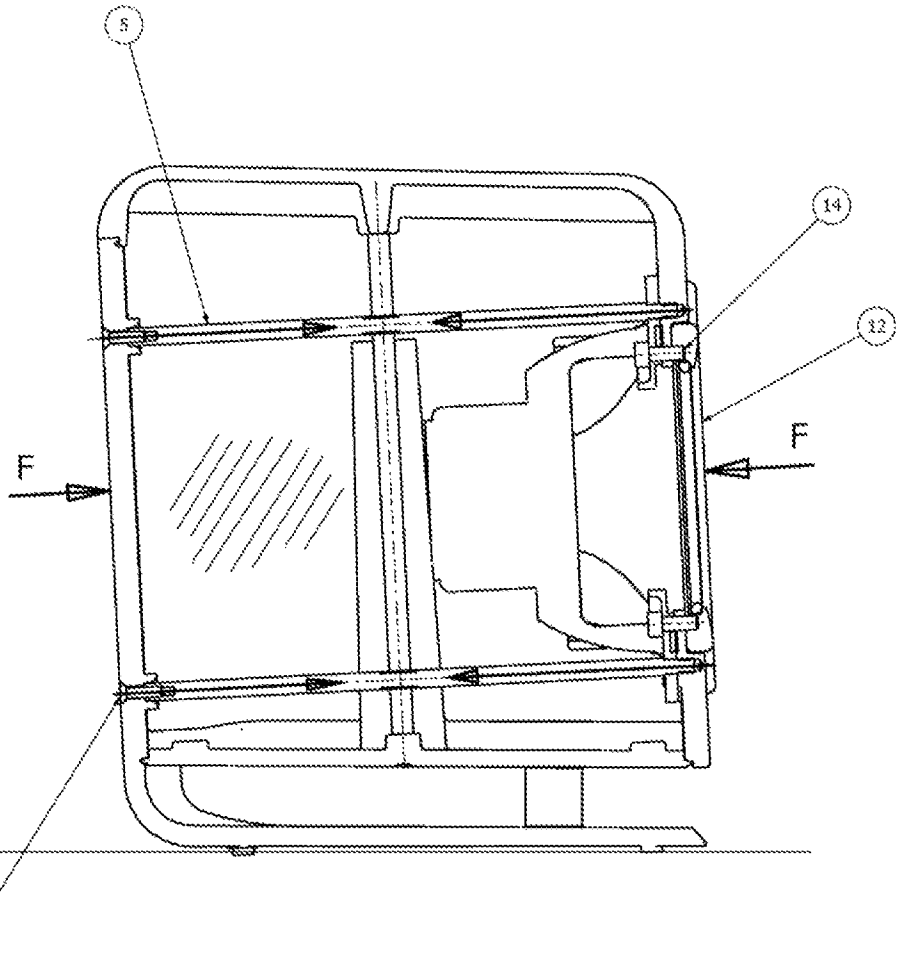
FIG. 2B is a side elevation cross-sectional view of the cabinet shown in FIG. 1, with the cross-section taken through the plane of a first set of horizontally-oriented tension rods.
Figure 2A:
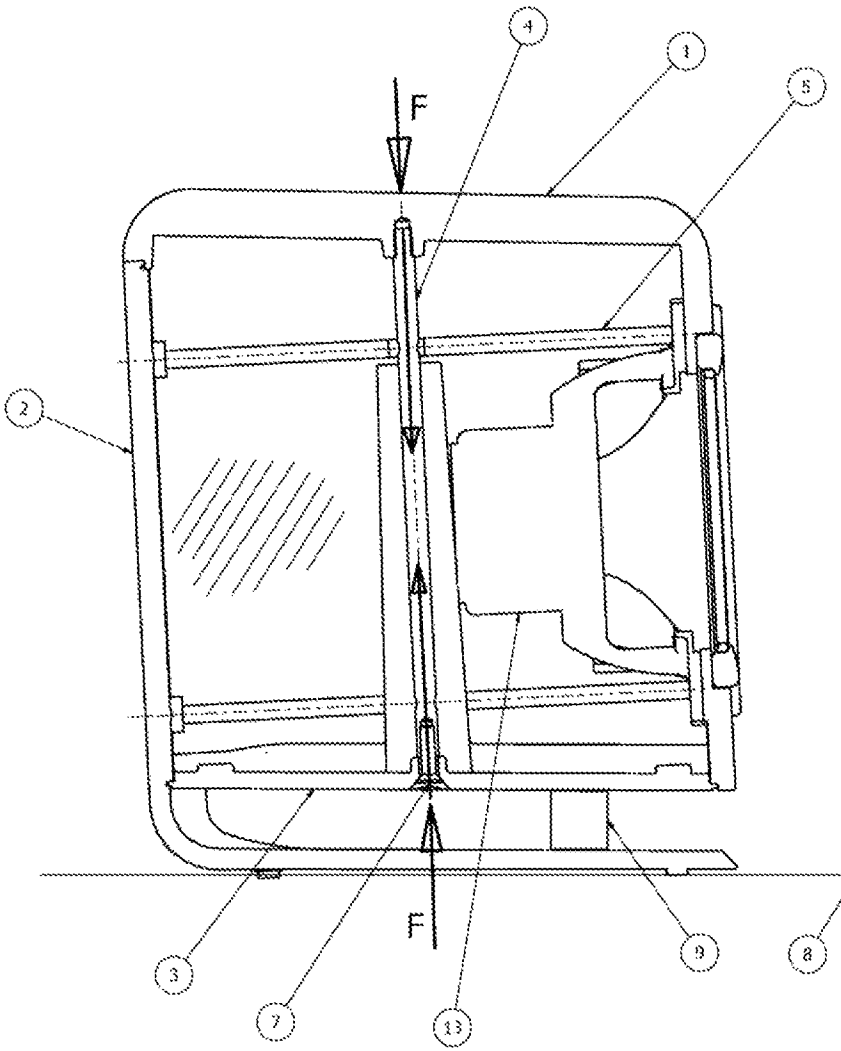
FIG. 2A is a side elevation cross-sectional view of the cabinet shown in FIG. 1, with the cross-section taken through the plane of vertically-oriented tension rods.

FIGS. 2A and 2B illustrate how tension forces F may be applied to the cabinet panels 1, 2, 3 in both the vertical and horizontal directions by tension members 4 and 5, respectively. Also depicted are example fasteners 7 and 8 that fasten the panels 1, 2, 3 with the tension rods 4 and 5. In the example embodiment shown in the Figures, provided are two centrally-located vertical tension members 4 and four spaced-apart horizontal tension members 5.

Figure 6A:
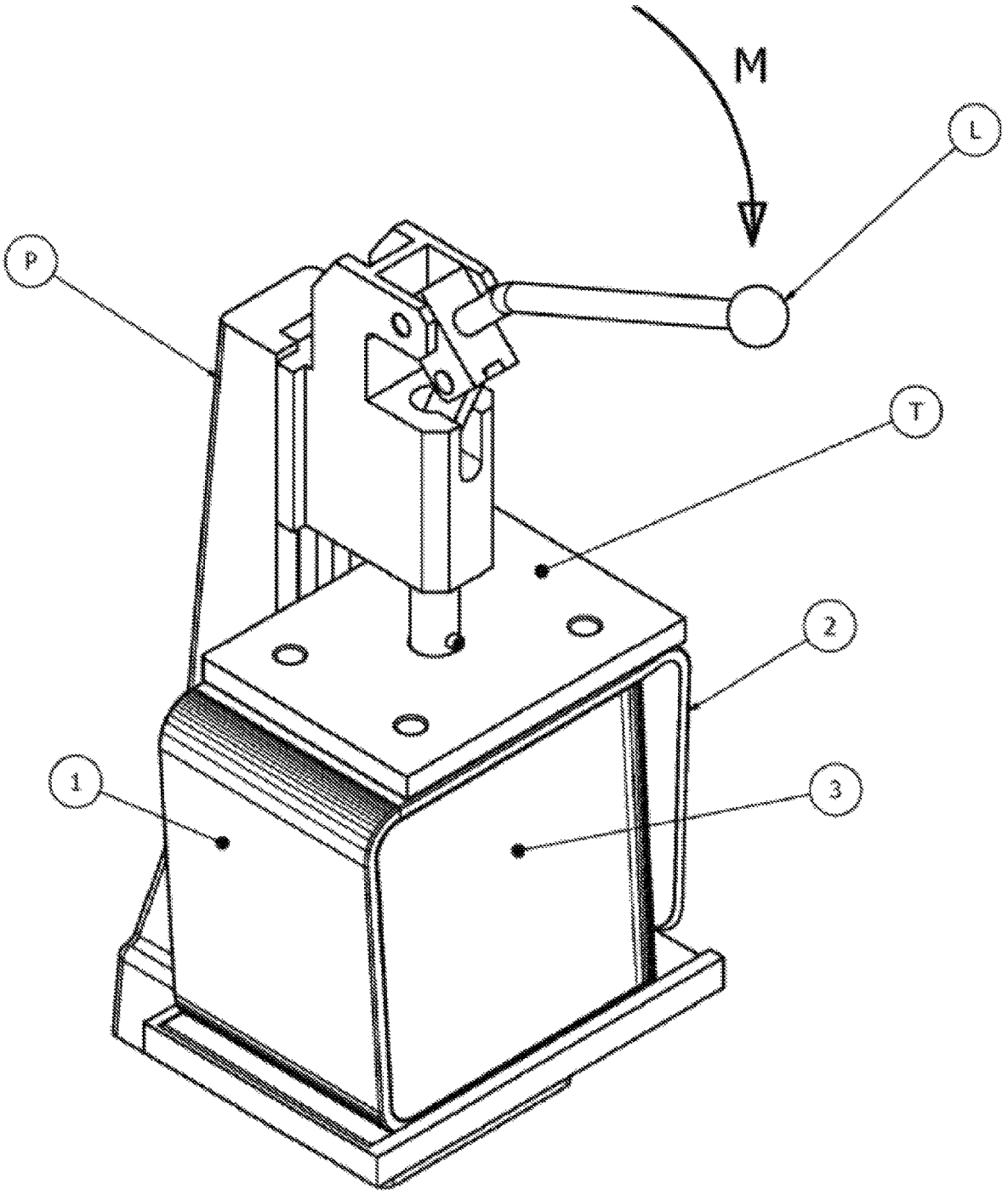
FIG. 6A is a perspective view of an example mechanical press being used in the assembly process of the cabinet of FIG. 1.
Figure 6B:
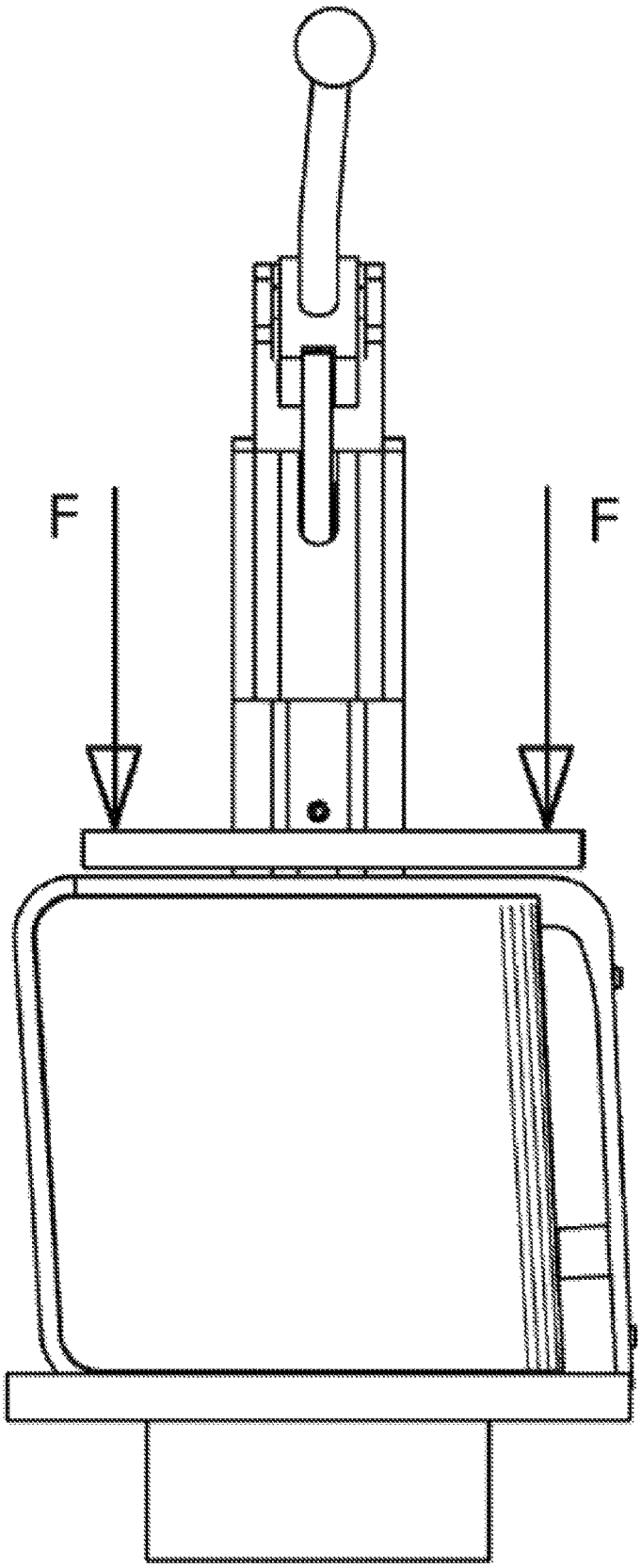
FIG. 6B is a side view of the example mechanical press of FIG. 6A being used in the assembly process of the cabinet of FIG. 1.
Figure 7A:
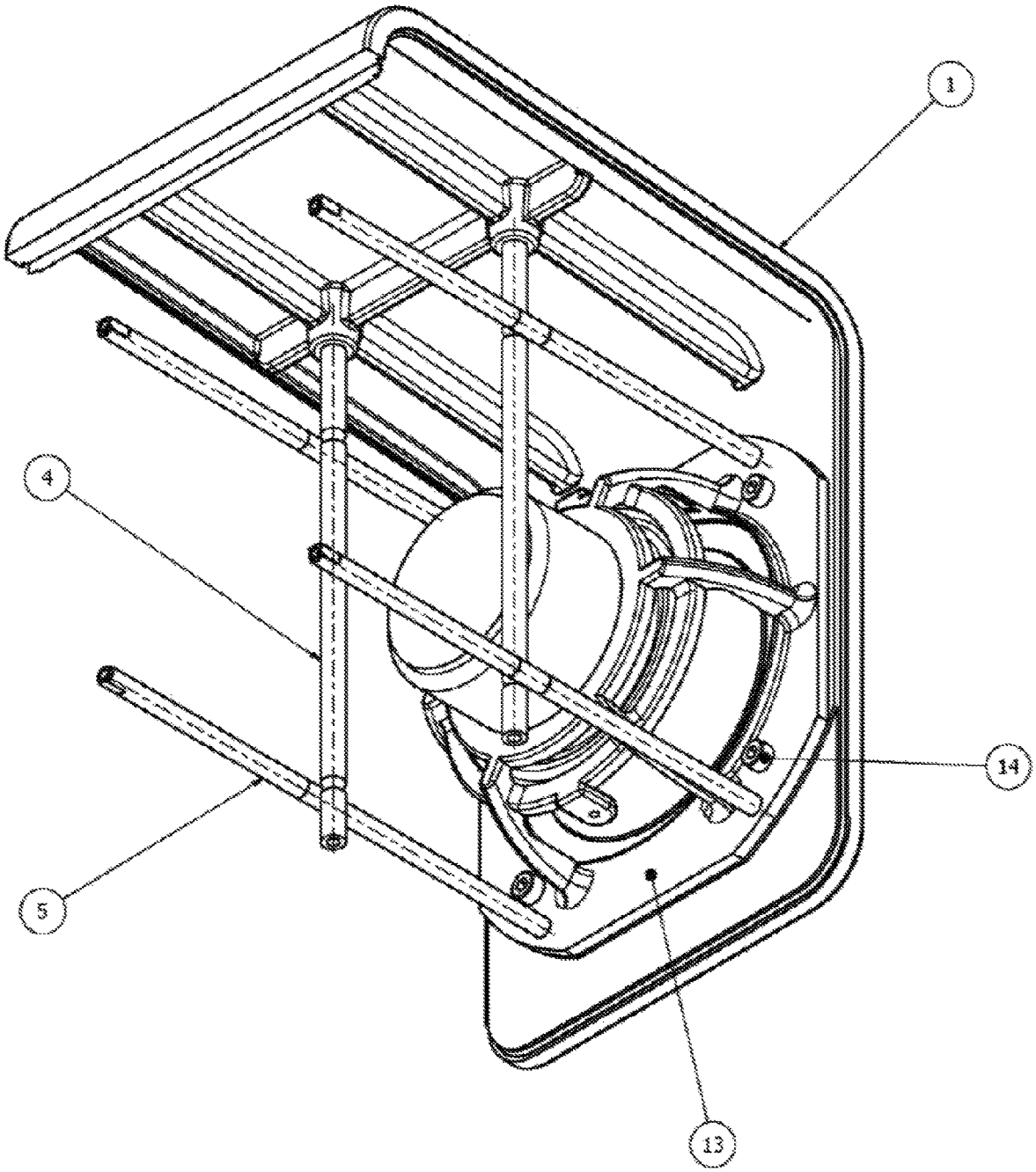
FIG. 7A is a perspective view of an example disassembled front panel of the cabinet shown in FIG. 1A, shown with an example speaker and example tension rods attached therewith.
Figure 7B:
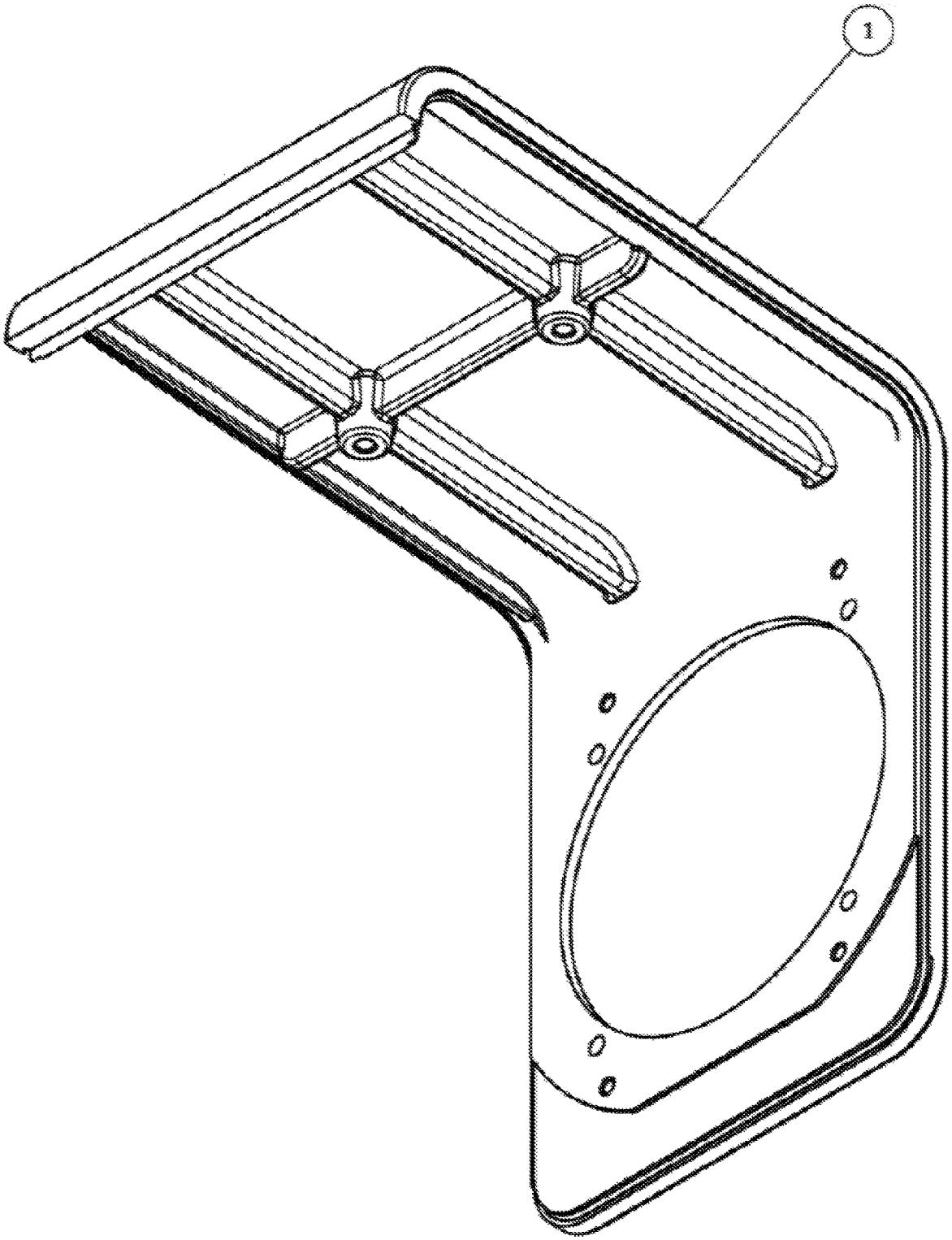
FIG. 7B is a perspective view of the example disassembled front panel of FIG. 7A, shown without the example speaker and without example tension rods attached therewith.

FIGS. 3, 4, 5, 5 A-A, and 5 B-B illustrate examples of how panels making up the speaker body, such as panels 1, 2, and 3, may interlock with each other using an example tongue and groove system. During assembly, the V-shaped tongue cross-section of the outer edge of the side panel 3 may slide along and into the correspondingly sized, shaped, and located V-shaped grooves formed in the front 1 and rear 2 panels, as these components are positioned adjacent one another and then compressed together, for instance as shown in FIGS. 6A and 6B. The detail or zoomed-in views V, W, X, Y, Z in FIGS. 3 through 5 B-B provide magnified views of the tongue-and-groove interfaces. The convex edge or "tongue" runs along the entire perimeter of the side panel 3, and may be formed as an integrated element of the one-piece side panel 3. The wedge shaped tongue and grooves allows for positive interlocking of the panels 1, 2, and 3, and creates an air-tight labyrinth within the assembled speaker cabinet or housing, meaning the loudspeaker cabinet is effectively air-tight. The labyrinth interlock created by the presented tongue-and-groove system is a good way to prevent pressurized air from leaking out from inside the cabinet during operation. Air within the cabinet may be pressurized by the front-to-back movement of the driver's membrane increasing the air pressure inside the cabinet. Leakage of such pressurized air from a speaker cabinet, especially from a compact loudspeaker cabinet, can cause a detectable "whistling" noise, which the present design avoids. The interlocking of the panels in the present manner has also been found to be an effective way of blocking edge vibrations and resonances of the side panel 3, similar to how holding a bell prevents it from ringing. While a V-shaped tongue and groove system is disclosed in the example embodiment, it is understood that any suitable convexly-shaped panel edge forced into any correspondingly sized, shaped, and located concave grooves in adjacent panels may be used.

FIGS. 6A and 6B illustrate how the interlocking assembly process of the panels 1, 2, and 3 may be implemented by the use of a mechanical press or equivalent means. The locking plate T of the press P forces the rear panel 2 onto the sub-assembly of the front and side panels, 1, 3. This may compress the cabinet under hundreds or thousands of pounds of force, creating enormous pressure on the tongue-and-groove connection joints, which may thereby be swaged together. Afterwards the panels 1, 2, and 3 can be locked in this position by tightening the screws or other fastener mechanisms, 7, 8, 10, 11. The force F indicated in FIG. 6B may be executed by the action of moving the press lever L in direction M as indicated in FIG. 6A.

Figure 8A:
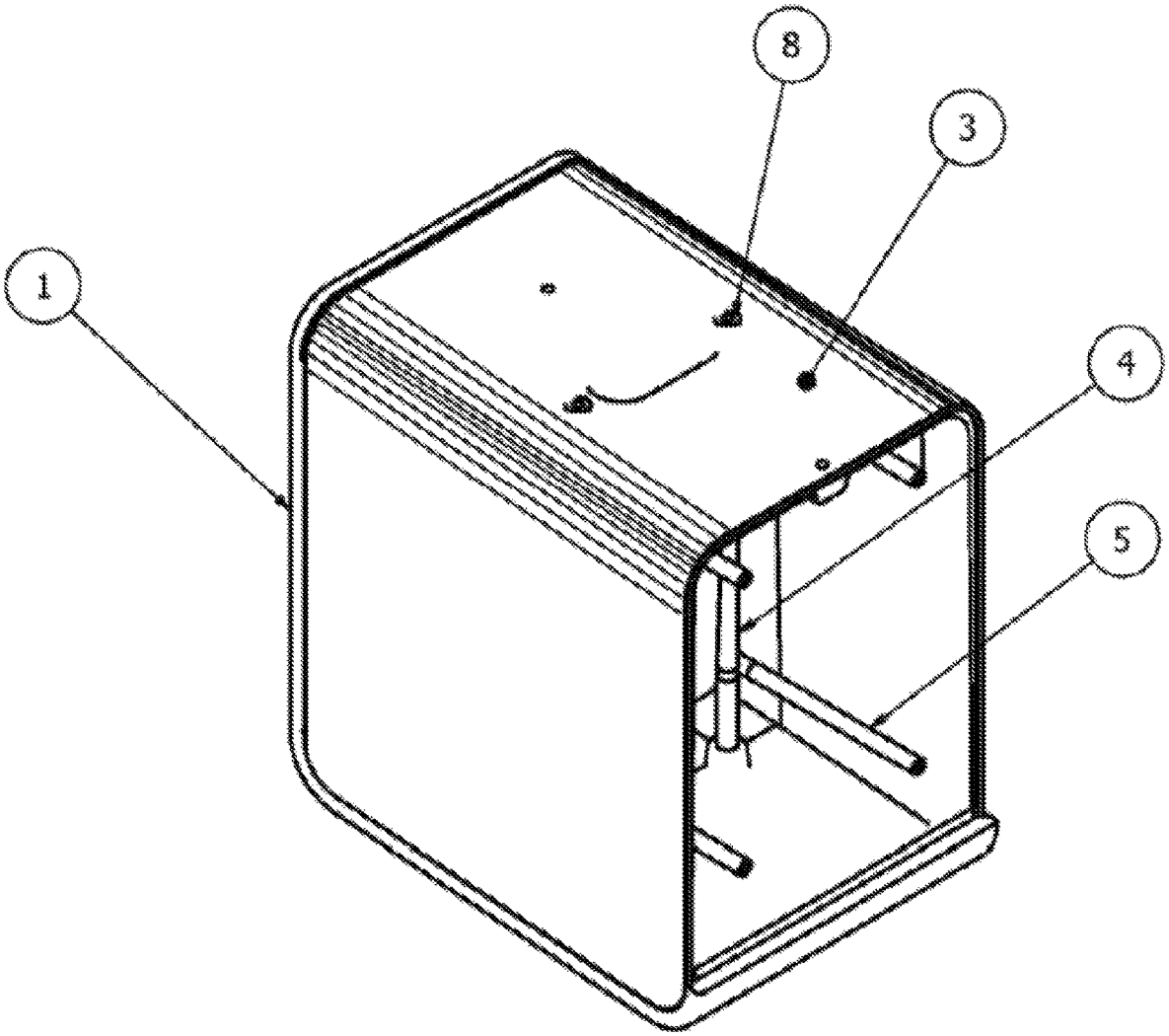
FIG. 8A is a perspective view of a partial assembly of the cabinet of FIG. 1, showing an example front-top panel assembled with an example side-inner-bottom-side panel.
Figure 8B:
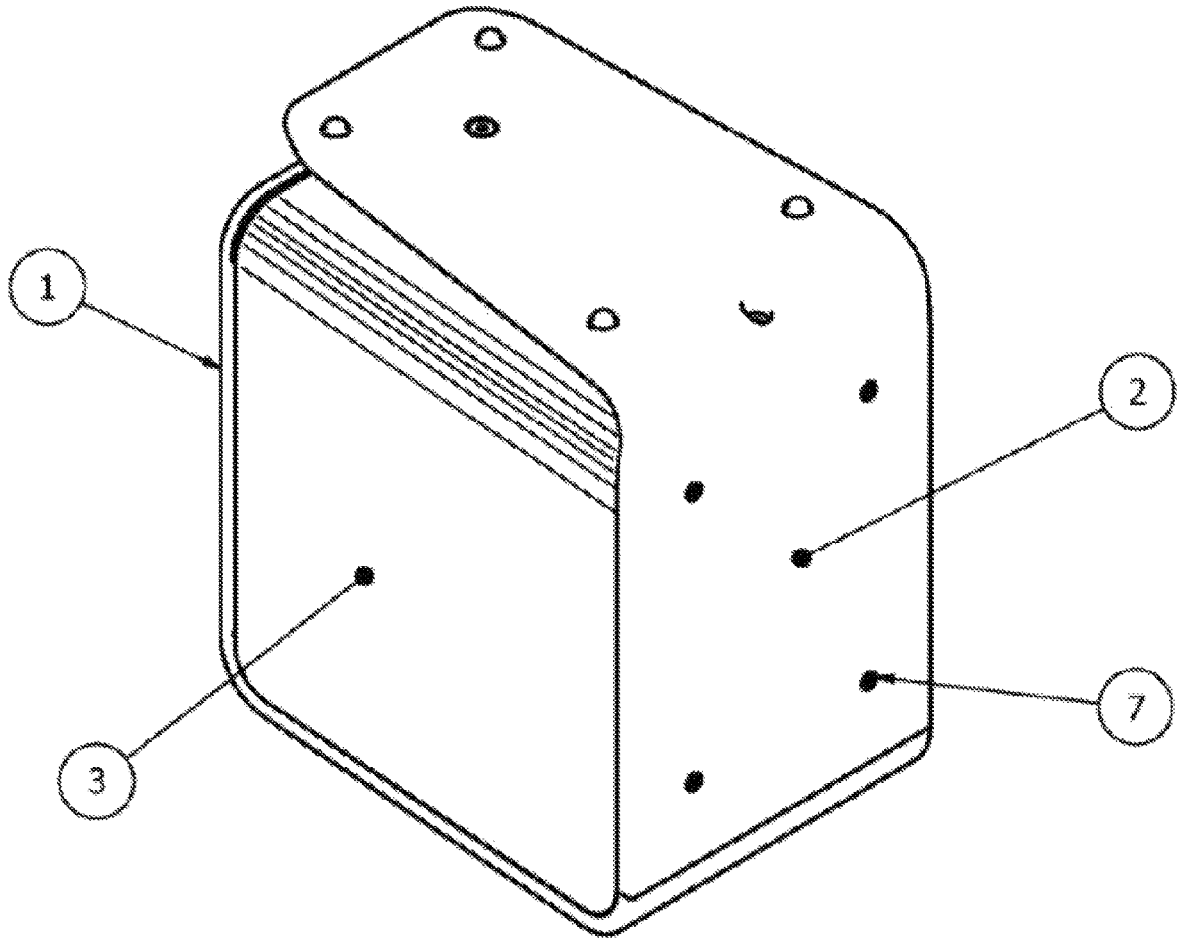
FIG. 8B is a perspective view of a fully assembly of the cabinet of FIG. 1, showing an example front-top panel assembled with an example side-inner-bottom-side panel and an example rear-outer-bottom panel.

FIGS. 7A through 8B illustrate example steps of an assembly process of exemplary panels 1, 2, and 3. Tension rods 4 and 5 may be screwed or otherwise attached to the front panel 1. This particular application illustrates how the loudspeaker driver may be used as a mechanical component of the cabinet, by serving as a panel reinforcement by being attached to front panel 1 with fasteners 14. The driver's fasteners 14, such as screws, and tension members 5, such as rods, lock the front panel 1 between the driver's basket 13 and the front aluminum grill ring 12. This reinforcement is very effective, because the total front panel thickness rises by adding the driver's frame and the front grill ring (see, e.g., FIGS. 2A, 2B). In the present system and method, it may be desirable for the panels 1, 2, 3 to be very resistant to bending. Because of the sandwiched construction shown in the example embodiment, the front panel 1 is also very effective in panel resonance suppression. FIG. 8A illustrates the sub-assembly of the front panel 1 with the side panel 3, and FIG. 8B illustrates the sub-assembly of FIG. 8A with the addition of the rear panel 2 attached with fasteners 7, creating a fully assembled loudspeaker (shown upside down with the foot area of the rear panel 2 in the upward position).

As shown in the figures, one, two, or all three of the panels 1, 2, and 3 may have generously and correspondingly radiused bends and corners, for instance bends and corners having a radius two, three, four, or more times greater than the nominal thickness of the respective panels 1, 2, and 3. In certain example embodiments, the front panel 1 may extend around two sides of the generally U-shaped side panel 3 and partially around a third side of the generally U-shaped side panel 3, such as shown in the figures, where a terminal edge of the front panel 1 may meet and be seal-ably connected against a corresponding terminal edge of the back panel 2.

It is understood that any suitable materials, geometries, and mechanical structures for the cabinet, tension members, and fastener mechanisms may be used to implement the present invention in these or other example embodiments. Any of the suitable technologies set forth and incorporated herein may be used to implement various example aspects of the invention as would be apparent to one of skill in the art. Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. A method of assembling from three panels an enclosed loudspeaker cabinet having at least a front side, back side, left side, right side, top side, and bottom side, comprising the steps of:

providing a first panel comprising a continuous outer edge having a first cross-section defining a convex shape;

providing a second panel comprising a first surface defining a first concave groove having a second cross-section sized and shaped to correspond to the convex shape of the first cross-section of the continuous outer edge of the first panel, the first concave groove extending along a first path sized and shaped to correspond to at least a first portion of the continuous outer edge of the first panel;

providing a third panel comprising a second surface defining a second concave groove having a third cross-section sized and shaped to correspond to the convex shape of the first cross-section of the continuous outer edge of the first panel, the second concave groove extending along a second path sized and shaped to correspond to at least a second portion of the continuous outer edge of the first panel; and assembling together the first, second, and third panels by forcing the continuous outer edge of the first panel into both the first concave groove of the second panel and the second concave groove of the third panel.

2. The method of claim 1, wherein the steps of forcing the continuous outer edge of the first panel into both the first concave groove of the second panel and the second concave groove of the third panel, further comprise the steps of:

placing the loudspeaker cabinet into a pressing machine, and causing the pressing machine to apply force to one or more of the first, second, and third panels to force the continuous outer edge of the first panel into both the first concave groove of the second panel and the second concave groove of the third panel.

3. The method of claim 2, wherein the steps of placing the enclosed loudspeaker cabinet into a pressing machine, and causing the pressing machine to apply force to one or more of the first, second, and third panels to force the continuous outer edge of the first panel into both the first concave groove of the second panel and the second concave groove of the third panel, further comprise the steps of:

at least partially swaging the continuous outer edge of the first panel into both the first concave groove of the second panel and the second concave groove of the third panel.

4. The method of claim 1, further comprising the steps of:

urging the continuous outer edge of the first panel into both the first concave groove of the second panel and the second concave groove of the third panel by:

providing at least first tension members and second tension members within the loudspeaker cabinet, wherein the first tension members extend from the second panel to the third panel, and the second tension members extend from the first panel to the second panel;

applying tension to the first tension members and thereby urging the second and third panels against the first panel; and applying tension to the second tension members and thereby urging the first panel against the second panel.

5. The method of claim 1, wherein the first panel is generally U-shaped in cross-section and the second and third panels are each generally L-shaped in cross-section, further comprising the steps of assembling from the first, second, and third panels an enclosed loudspeaker cabinet having at least a front side, back side, left side, right side, top side, bottom side, and foot portion extending laterally under the bottom side, by attaching the second and third panels to the first panel so that a portion of the third panel extends laterally under the first panel.

6. An enclosed loudspeaker cabinet having at least a front side, back side, left side, right side, top side, and bottom side, formed from three panels, comprising:

a first panel comprising a continuous outer edge having a first cross-section defining a convex shape;

a second panel comprising a first surface defining a first concave groove having a second cross-section sized and shaped to correspond to the convex shape of the first cross-section of the continuous outer edge of the first panel, the first concave groove extending along a first path sized and shaped to correspond to at least a first portion of the continuous outer edge of the first panel;

a third panel comprising a second surface defining a second concave groove having a third cross-section sized and shaped to correspond to the convex shape of the first cross-section of the continuous outer edge of the first panel, the second concave groove extending along a second path sized and shaped to correspond to at least a second portion of the continuous outer edge of the first panel;

the second and third panels in forcible engagement with the first panel such that the continuous outer edge of the first panel is sealably adjoined into both the first concave groove of the second panel and the second concave groove of the third panel.

7. The enclosed loudspeaker cabinet of claim 6, wherein the continuous outer edge of the first panel is at least partially swaged into both the first concave groove of the second panel and the second concave groove of the third panel.

8. The enclosed loudspeaker cabinet of claim 6, wherein the convex shape of the first cross-section of the continuous outer edge of the first panel comprises a V-shape.

9. The enclosed loudspeaker cabinet of claim 6, wherein the first, second, and third panels are cast aluminum.

10. The enclosed loudspeaker cabinet of claim 6, further comprising:

at least first tension members and second tension members within the loudspeaker cabinet, wherein the first tension members extend from the second panel to the third panel, and the second tension members extend from the first panel to the second panel;

the first tension members urging the second and third panels against the first panel; and the second tension members urging the first panel against the second panel.

11. The enclosed loudspeaker cabinet of claim 10, wherein the first tension members extend in a first longitudinal direction and the second tension members extend in a second longitudinal direction, and the first longitudinal direction is substantially perpendicular to the second longitudinal direction.

12. The enclosed loudspeaker cabinet of claim 10, wherein the first tension members comprise four tension members.

13. The enclosed loudspeaker cabinet of claim 11, wherein the second tension members comprise two tension members.

14. The enclosed loudspeaker cabinet of claim 6, further comprising a foot portion extending laterally under the bottom side, wherein the first panel is generally U-shaped in cross-section and the second and third panels are each generally L-shaped in cross-section, and the second and third panels are attached to the first panel so that a portion of the third panel extends laterally under the first panel, forming the foot portion.

15. The enclosed loudspeaker cabinet of claim 14, further comprising a rigid spacer extending between the foot portion and the first panel.

16. The enclosed loudspeaker cabinet of claim 15, wherein the rigid spacer is metal.

17. The enclosed loudspeaker cabinet of claim 6, wherein the second panel comprises an opening formed there through, further comprising a speaker driver mounted in the opening in the second panel.

18. The enclosed loudspeaker cabinet of claim 17, wherein the speaker comprises a frame mounted adjacent the second panel that reinforces the second panel.

* * * * *